US009534410B2

(12) United States Patent
Shani et al.

(10) Patent No.: US 9,534,410 B2
(45) Date of Patent: Jan. 3, 2017

(54) VEHICLE SHUTTLE

(71) Applicant: UNITRONICS AUTOMATED SOLUTIONS LTD., Airport (IL)

(72) Inventors: Haim Shani, Shoham (IL); Zvi Raz, Petach Tikva (IL)

(73) Assignee: UNITRONICS AUTOMATED SOLUTIONS LTD, Ben Gurion Airport (IL)

( * ) Notice: Subject to any disclaimer, the term of this patent is extended or adjusted under 35 U.S.C. 154(b) by 463 days.

(21) Appl. No.: 13/902,993

(22) Filed: May 28, 2013

(65) Prior Publication Data

US 2013/0251481 A1 Sep. 26, 2013

Related U.S. Application Data

(63) Continuation-in-part of application No. 12/573,480, filed on Oct. 5, 2009, now Pat. No. 8,613,582.

(60) Provisional application No. 61/103,087, filed on Oct. 6, 2006.

(51) Int. Cl.

| | |
|---|---|
| ***E04H 6/22*** | (2006.01) |
| ***E04H 6/34*** | (2006.01) |
| ***E04H 6/24*** | (2006.01) |
| ***E04H 6/36*** | (2006.01) |

(52) U.S. Cl.

CPC *E04H 6/34* (2013.01); *E04H 6/24* (2013.01); *E04H 6/36* (2013.01)

(58) Field of Classification Search

CPC ..... E04H 6/34; E04H 6/36; E04H 6/24

See application file for complete search history.

(56) References Cited

U.S. PATENT DOCUMENTS

| | | | | |
|---|---|---|---|---|
| 2,556,175 | A * | 6/1951 | Frost | 14/2.4 |
| 3,031,024 | A * | 4/1962 | Ulinski | 180/6.5 |
| 3,534,239 | A * | 10/1970 | Risberg | 318/52 |
| 4,103,795 | A | 8/1978 | Miller | |
| 4,252,495 | A * | 2/1981 | Cook | 414/608 |
| 4,459,078 | A | 7/1984 | Chiantella | |
| 4,588,345 | A * | 5/1986 | Anttila | B66F 9/186 280/43.23 |
| 5,708,427 | A * | 1/1998 | Bush | 340/941 |
| 2004/0067124 | A1 | 4/2004 | Lee | |
| 2007/0112497 | A1* | 5/2007 | Miura et al. | 701/70 |
| 2008/0031711 | A1 | 2/2008 | Yook et al. | |
| 2009/0088914 | A1* | 4/2009 | Mizutani et al. | 701/22 |
| 2010/0086385 | A1 | 4/2010 | Shani | |

OTHER PUBLICATIONS

Office Action of U.S. Appl. No. 14/138,069 mailed on Feb. 12, 2016.

* cited by examiner

*Primary Examiner* — Scott Lowe

(74) *Attorney, Agent, or Firm* — Pearl Cohen Zedek Latzer Baratz LLP

(57) ABSTRACT

A vehicle shuttle car operable to travel in linear and lateral directions includes a low profile cart including a steerable front section and a rear section, the front section operable to turn left and right relative to the rear section. The rear section is operable to raise and support at least one tire of a vehicle off the ground.

13 Claims, 5 Drawing Sheets

VEHICLE SHUTTLE

CROSS-REFERENCE TO RELATED APPLICATIONS

This application is a continuation-in-part application claiming benefit from U.S. patent application Ser. No. 12/573,480 filed Oct. 5, 2009, which claims benefit from U.S. Provisional Patent Application: 61/103,087, filed Oct. 6, 2008, which is hereby incorporated in its entirety by reference.

FIELD OF THE INVENTION

The present invention relates to shuttle cars for moving stationary vehicles in parking facilities, generally automated parking facilities, and to a maneuverable shuttle car for moving stationary vehicles in automated and non-automated parking facilities, as well as other types of vehicle parking areas, tin particular.

BACKGROUND OF THE INVENTION

In conventional three-dimensional automated vehicle parking garages, mechanical elements or motorized conveyances, such as lifts (elevators), cranes, shuttle cars (moving platforms), turntables, and other mechanical elements are used to transport a vehicle from an entry/exit station at the arrival/departure level of the parking garage to a parking space in the parking garage and then retrieve the vehicle from the parking space and transport the vehicle to the entry/exit station, without human assistance.

A conventional shuttle car typically may comprise a single, unitary platform capable of raising a vehicle, or parts of a vehicle such as the front portion or the back portion, using hydraulic or other means and transporting the vehicle in a horizontal direction. These shuttle cars are generally configured to travel forward and backwards along a same axis. Yook et al. in US Patent Application Publication No. US 2008/0031711, describe "a vehicle transport apparatus for parking systems. The vehicle transport apparatus of the present invention includes a first platform, onto which a vehicle is placed, a second platform, which is provided in a parking space, and a pair of carriers and which move between the first platform and the second platform. Each carrier includes a main frame, a drive wheel which is provided in the main frame, a drive motor which rotates the drive wheel; a pair of arms which are rotatably mounted to each of opposite sides of the main frame, and a hydraulic device which rotates the arms. The arms lift the wheels when extracted from the main frame, and the carriers transports the vehicle lifted by the arms from one platform to another platform," Applicants in U.S. patent application Ser. No. 12/573,480 and from which this patent application is a continuation-in-part, describe "a system of shuttle cars for transporting a vehicle in an automated parking facility. Each shuttle car includes an x-shuttle that supports two z-shuttles. The z-shuttles move from the x-shuttle and under the vehicle for transport. The z-shuttles locate and engage the front and rear tires of a vehicle to lift the vehicle from the floor. Once the z-shuttles have engaged the vehicle tires, the z-shuttles return to the x-shuttle so that the x-shuttle can transport the vehicle (and the z-shuttles) to and from the appropriate parking space."

SUMMARY OF THE INVENTION

There is provided, according to an embodiment of the present invention, a vehicle shuttle car operable to travel in linear and lateral directions including a low profile cart including a steerable front section and a rear section, the front section operable to turn left and right relative to the rear section, and the rear section operable to raise and support at least one tire of a vehicle off the ground.

According to an embodiment of the present invention, the vehicle shuttle car includes a first drive mechanism for driving wheels on a left side of the front section and a second drive mechanism for driving wheels on a right side of the front section.

According to an embodiment of the present invention, the first drive mechanism and the second drive mechanism are operable to drive the left side wheels and the right side wheels at different speeds.

According to an embodiment of the present invention, the vehicle shuttle car includes a third drive mechanism for driving wheels on a left side and a right side of the rear section.

According to an embodiment of the present invention, the first, second, and third drive mechanisms include any of an electric motor any a hydraulic motor.

According to an embodiment of the present invention, the vehicle shuttle car includes a guiding system to direct vehicle shuttle travel in a linear direction and a lateral direction.

According to an embodiment of the present invention, the guiding system includes an image detector to detect images and markings in the automated parking facility.

According to an embodiment of the present invention, the image detector includes any one of, or any combination of, a laser detector, a video camera, an infrared detector, or a photo detector.

According to an embodiment of the present invention, the vehicle shuttle car includes a controller to control turning of the front section responsive to data received from a guiding system.

According to an embodiment of the present invention, the vehicle shuttle car includes sensors to detect a position of the cart with respect to the tires of a vehicle.

According to an embodiment of the present invention, the vehicle shuttle car includes a vehicle lifting system including at least four extendable members for pushing on the tires of a vehicle for lifting the vehicle.

According to an embodiment of the present invention, the at least four extendable members are retractable against sides of the cart.

According to an embodiment of the present invention, the vehicle lifting system includes at least one retraction mechanism for extending and retracting the at least four extendable members.

According to an embodiment of the present invention, the at least one retraction mechanism includes an electric motor.

According to an embodiment of the present invention, the at least one retraction mechanism includes a hydraulic piston.

BRIEF DESCRIPTION OF THE DRAWINGS

The subject matter regarded as the invention is particularly pointed out and distinctly claimed in the concluding portion of the specification. The invention, however, both as to organization and method of operation, together with objects, features, and advantages thereof, may best be understood by reference to the following detailed description when read with the accompanying drawings in which:

DETAILED DESCRIPTION OF THE PRESENT INVENTION

Figure 1:
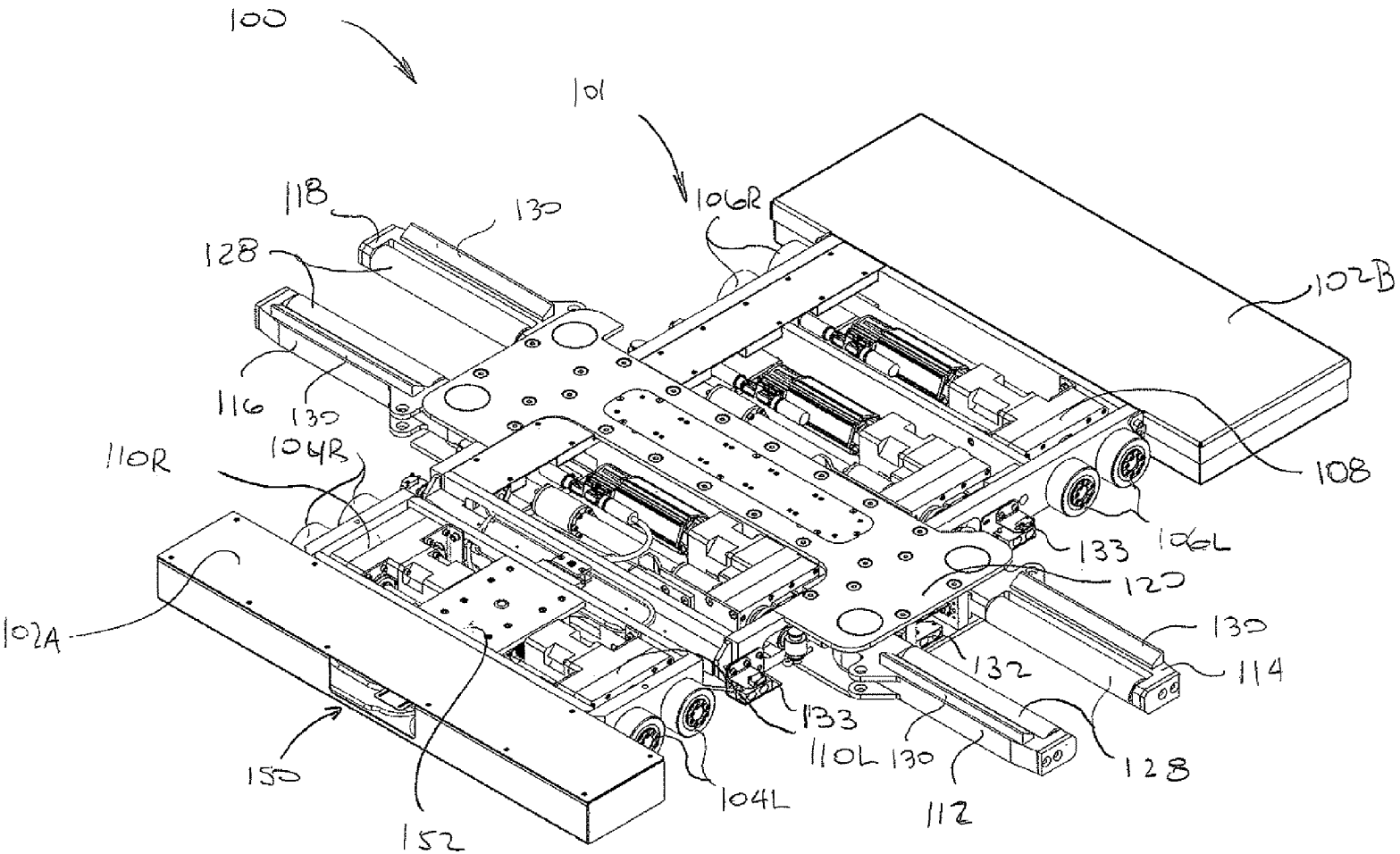
FIG. 1 is a perspective view of an exemplary improved z-shuttle, according to an embodiment of the present invention.
Figure 2:
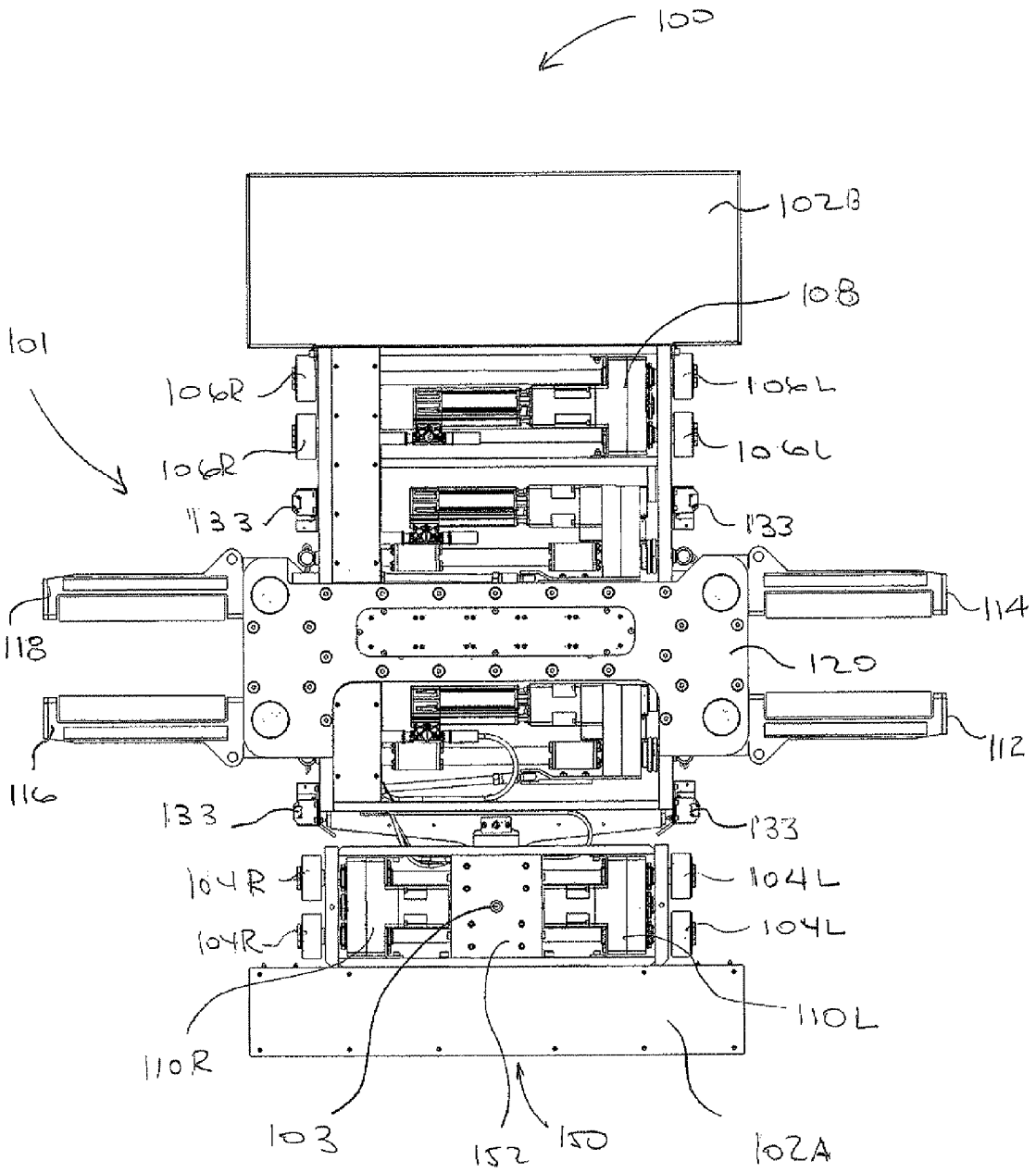
FIG. 2 is top view of the exemplary improved z-shuttle, according to an embodiment of the present invention.

In the following detailed description, numerous specific details are set forth in order to provide a thorough understanding of the invention. However, it will be understood by those skilled in the art that the present invention may be practiced without these specific details. In other instances, well-known methods, procedures, and components have not been described in detail so as not to obscure the present invention.

Applicants have devised an improved z-shuttle with lateral mobility allowing the z-shuttle to turn to the left and to the right (lateral motion) while travelling forwards and backwards (linear motion). This feature may be potentially advantageous as it may facilitate parking vehicles in channel-less floor parking spaces, with the additional advantage of positioning vehicles in tight parking spaces and in parking spaces which are oriented in different directions, potentially maximizing space utilization in automated parking facilities. The combined mobility in the improved z-shuttle may additionally allow for correcting deviations when positioning vehicles in parking spaces and on automated positioning equipment such as rotatable platforms (turntables); lifting platforms (lifts); floor positioning shuttles (moving platforms such as, for example, the x-shuttle described in the US application by the applicants); and cranes. Furthermore, the combined mobility in the improved z-shuttle may allow compensating for misalignments when positioning automated positioning equipment, whether against other automated positioning equipment, against parking space floors, at parking facility entry/exit bays, as may be required when moving vehicles inside the automated parking facility.

Applicants have further realized that an improved z-shuttle which may correct deviations during vehicle positioning and may compensate for misalignments when positioning automated positioning equipment alignment may allow for (1) controllers used in automated parking facilities to be simplified and/or to have their processing power diverted to applications other than that associated with accurate vehicle positioning; and (2) the automated positioning equipment to be simplified as guiding mechanisms used for accurate vehicle positioning, for example guide channels, guide rails, and signaling devices, may be substantially eliminated.

Applicants have also realized that an improved z-shuttle may be used in non-automated parking facilities and other type of facilities which require movement of stationary vehicles. Examples of facilities which require movement of stationary vehicles may include, for example, automobile repair shops (i.e. car garages), vehicle tow garages, single-story and multi-story non-automated parking garages, car wash garages, and any other type of facility which may benefit from driverless movement of vehicles. The improved z-shuttle may be used to move vehicles around inside the facilities, including moving the vehicles in and out of temporary and permanent parking locations. The parking locations may include tight parking spaces and parking spaces which are oriented in different directions, as well as work stations or work areas where work may be performed on a vehicle.

FIGS. 1-5 depict the details of an improved z-shuttle 100, according to an embodiment of the present invention. Z-shuttle 100 includes a low-profile cart or platform 101 having a steerable front section 102A attached to a rear section 102B suitable for lifting and supporting a section of a vehicle. For example, rear section 102B may support a section of a vehicle by lifting the front two tires or the rear two tires, so that lifting a vehicle of the ground for transport requires two z-shuttles 100 (one for the front tires and one for the back tires). Alternatively, one Z-shuttle 100 may lift a whole vehicle, for example, by rear section 102B supporting all four tires of a vehicle so that the vehicle is lifted off the ground for transport by the one Z-shuttle.

Front section 102A and rear section 102B may be attached using suitable means to allow the front section to turn to the left and to the right relative to the rear section, for example, by pivoting on a turning axis 103. Front section 102A may include two front left wheels 104L and two front right wheels 104R a front left drive mechanism 110L for driving the front left wheels, and a front right drive mechanism 110R for driving the front right wheels. Rear section 102B may include two left rear wheels 106L, two right rear wheels 106R, and a rear drive mechanism 108 for driving the rear wheels. Drive mechanisms 110L, 110R, and 108 may include electric and/or hydraulic motors. The term "electric", as used throughout this description may also refer to electromagnetic and magnetic. Although z-shuttle is shown in the figures with two rear left wheels 106L, two rear right wheels 106R, two front left wheels 104L and two front right wheels 104R, a skilled person may realize that the number of front and rear wheels used with the z-shuttle may be lesser or greater than shown, their size, and their type, may be dictated by weight and type of vehicle transported on the z-shuttle. Furthermore, the skilled person may realize that not all wheels need be propelled by the motors, and that some wheels may be free-rolling and may serve to support cart 101 when a vehicle is loaded onto the cart.

According to an embodiment of the present invention, improved z-shuttle 100 may move forward and backwards while moving to the left or to the right relative to a central axis of the z-shuttle, combining linear motion with lateral motion. Lateral motion may be imparted by drive mechanisms 110L and 110R which impart a different speed to the front wheels on one side of cart 101 relative to the front wheels on the other side. The differential speed may be implemented through drive mechanisms 110L and 110R by regulating the speed in each drive mechanism individually, so that front wheels 104L and 104R rotate at different speeds. For example, to cause lateral motion towards the left while z-shuttle 100 is moving forward, drive mechanism 110L may rotate front left wheels 104L at a slower speed compared to the speed at which drive mechanism 110R rotates front right wheels 104R. Inversely, to cause lateral motion towards the right while z-shuttle 100 is moving forward, drive mechanism 110L may rotate front left wheels 104L at a greater speed compared to the speed at which drive mechanism 110R rotates front right wheels 104R. When moving backwards, to cause z-shuttle 100 to move to the right, forward drive mechanism 110R may rotate front right wheel 104R at a greater speed compared to the speed at which forward drive mechanism 110L rotates front left wheel 104L, and inversely, to cause z-shuttle 100 to move to the left, forward drive mechanism 110R may rotate front right wheel 104R at a slower speed compared to the speed at which forward drive mechanism 110L rotates front left wheel 104L. By individually regulating the speeds of front left wheels 104L and front right wheels 104R, improved z-shuttle may be steered towards the left and the right to correct for deviations in positioning of the vehicle, for example, when placed on automated positioning equipment and/or in parking spaces, including work stations, or to correct for misalignments in the position of automated positioning equipment while a vehicle is transported through the automated parking facility, or for moving the vehicle in general in a left or right direction.

Improved z-shuttle 100 includes a guiding system 150 for steering cart 101. Guiding system 150, which may be included in front section 102A, may be used, for example, for steering cart 101 onto automated positioning equipment, and for steering the cart off the automated positioning system. Guiding system 150 may additionally be used for guiding cart 101 along a parking floor in and out of a parking space, for moving the cart in and out of an entry/exit bay, or in and out of a work station in a garage, among many other applications. Guiding system 150 may include an imaging device which captures and processes images and are processed by a controller 152 which controls the speed of front left wheels 104L and front right wheels 104R to propel cart 101 forwards or backwards, and left or right. Controller 152 may control the speed of the wheels by individually controlling drive mechanisms 110L and 110R. Controller 152 may additionally control the speed of rear wheels 106L and 106R by controlling drive mechanism 108. The imaging device may include video imaging, infrared imaging, electromagnetic imaging or other known imaging techniques, or any combination thereof. Guiding system 150 may include magnetic sensing to detect metallic stripes (or metallic paint) which may be placed on the surface of floors on which z-shuttle 100 is to travel, for example, parking floors, automated positioning equipment, entry/exit bays, and work stations, among others, and which may serve to direct cart 101 during travel and positioning. Guiding system 150 may include other means and techniques known in the art for detecting images, surroundings, markings, and the like, and which may provide input data to controller 152 to allow the controller to regulate the speed of front left wheels 104L and front right wheels 104R for both linear and lateral motion.

Guiding system 150 may be additionally operable to detect a distance between two improved z-shuttles 100, for example, when one the z-shuttles is used to lift the front tires of a vehicle and the other to lift the rear tires of the vehicle. By means of controller 152 in each improved z-shuttle, movement of the two improved z-shuttles may be synchronized for transporting the vehicle while maintaining a substantially same distance between them. Guiding system 150 may include wireless communication means to allow communication between the two improved z-shuttles 100 to possibly assist in synchronizing their movement, although each improved z-shuttle 100 may be independently guided by its guiding system 150 with synchronization of their movement inherently controlled by controllers 152 in each improved z-shuttle as each controller regulates linear and lateral motion.

Controller 152 may be a programmable logic controller or other controller to control the movement of improved z-shuttle 100 and operate other on-board systems including guiding system 150, tire positioning sensors 132, the communication means, and four retractable members 112, 114, 116, and 118 which are used to lift vehicle tires and are described more fully below.

Figure 3:
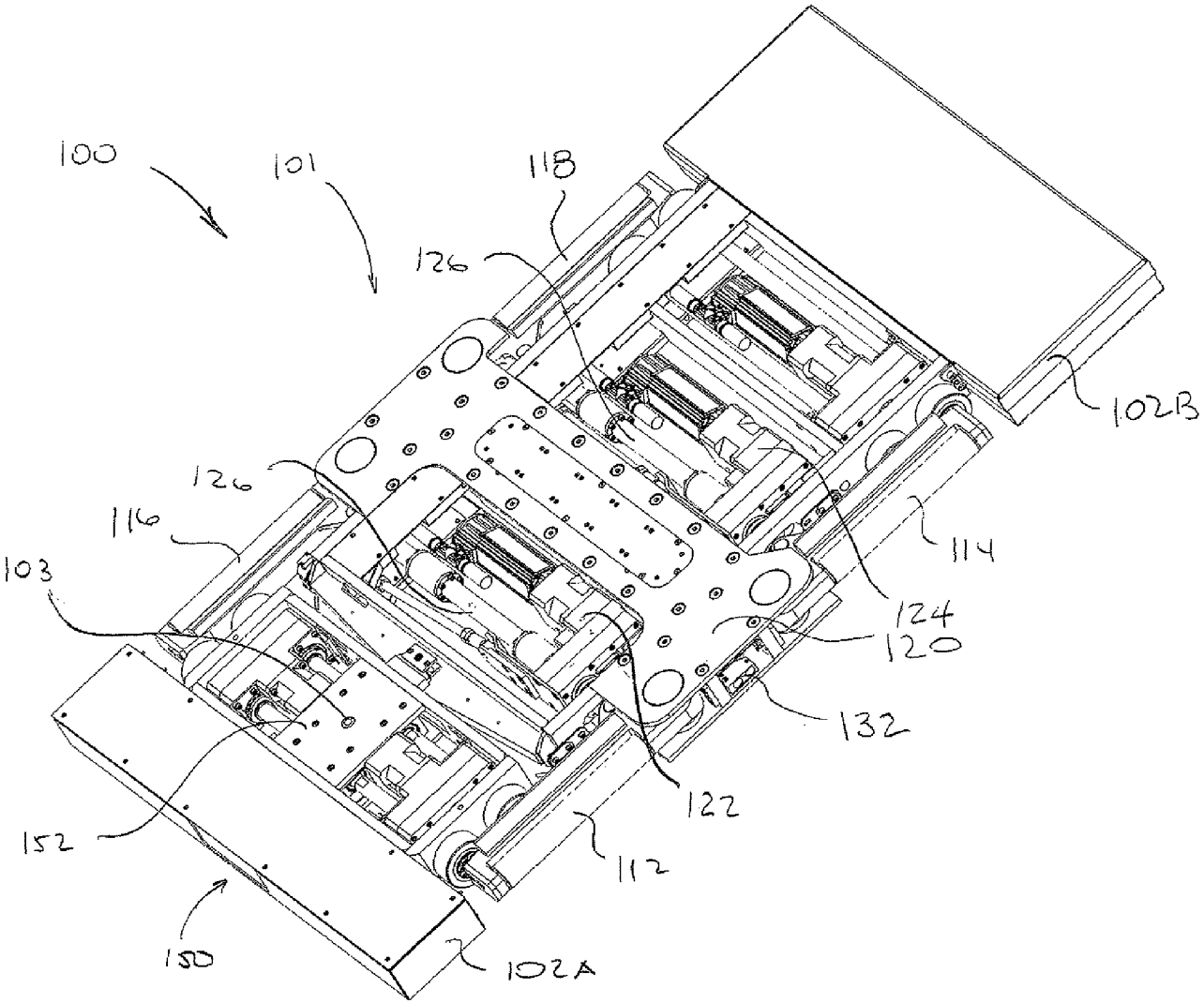
FIG. 3 is a perspective view of the exemplary z-shuttle with retracted lifting members, according to an embodiment of the present invention.
Figure 4:
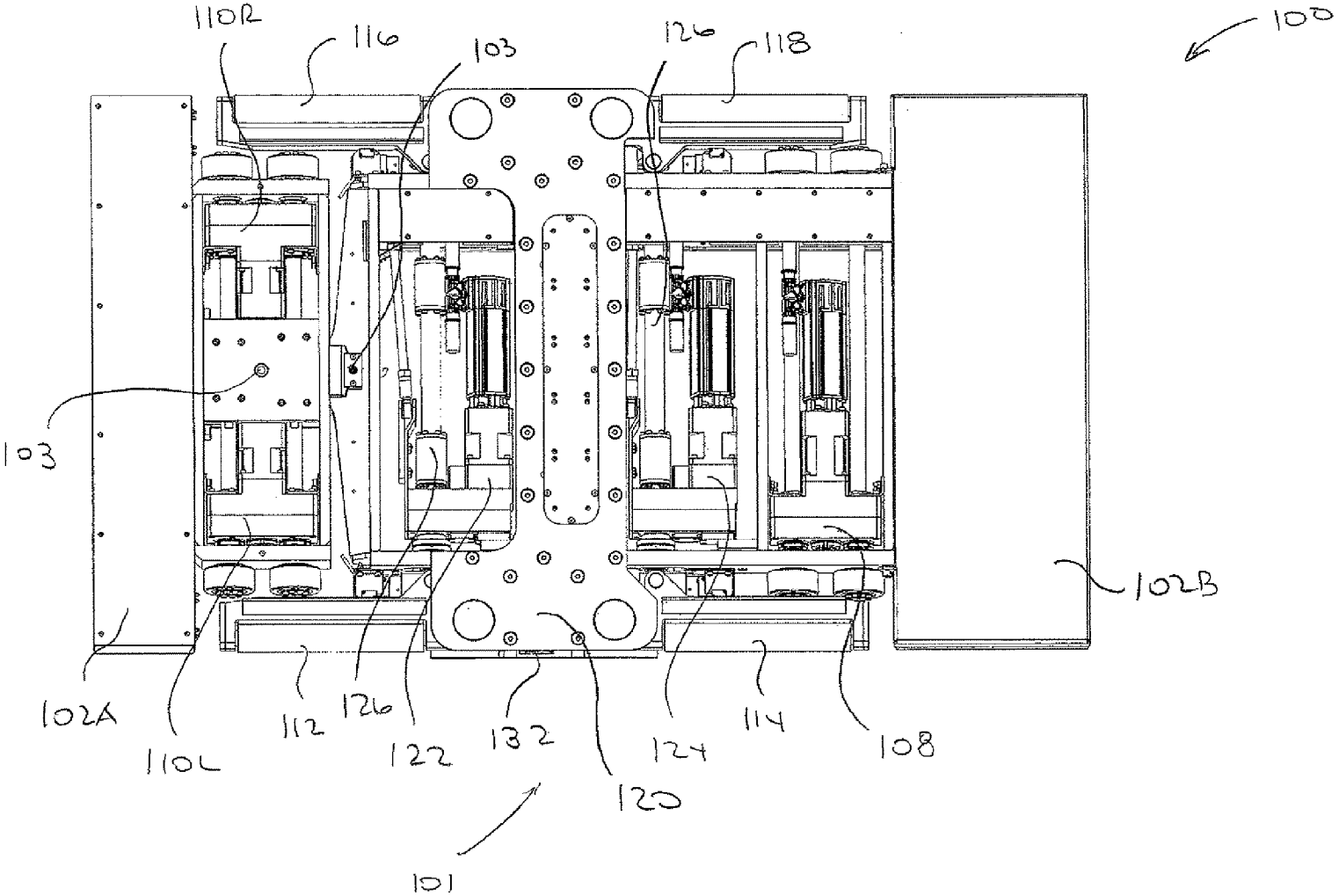
FIG. 4 is a top view of the exemplary z-shuttle with retracted lifting members, according to an embodiment of the present invention.
Figure 5:
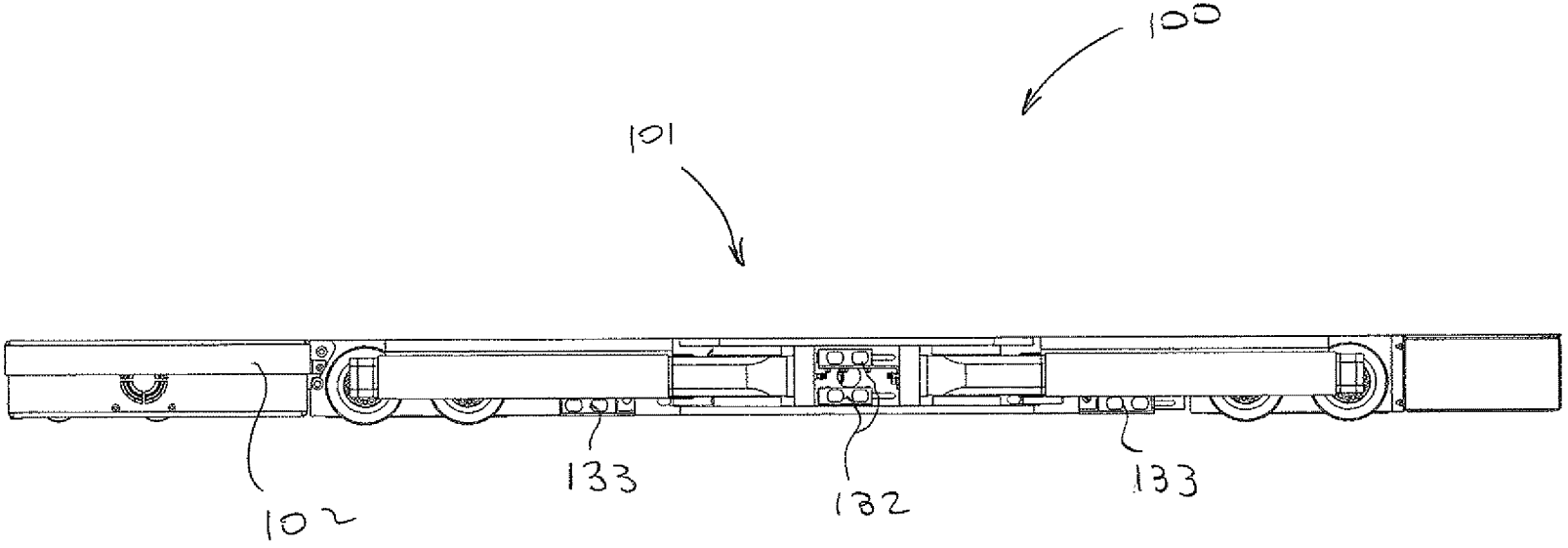
FIG. 5 is a side view of the exemplary z-shuttle with retracted lifting members, according to an embodiment of the present invention It will be appreciated that for simplicity and clarity of illustration, elements shown in the figures have not necessarily been drawn to scale. For example, the dimensions of some of the elements may be exaggerated relative to other elements for clarity. Further, where considered appropriate, reference numerals may be repeated among the figures to indicate corresponding or analogous elements.

Retractable members 112, 114, 116, and 118 are located on rear section 102B and are utilized to lift a vehicle by the tires and hold the vehicle in place during transport. Retractable members 112, 114, 116, and 118 are capable of being retracted toward the sides of improved z-shuttle 100, in a direction towards the wheels as depicted in FIGS. 3, 4, and 5. Retractable member 112 may be retracted towards front left wheels 104L, retractable member 114 may be retracted towards rear left wheels 106L, retractable member 116 may be retracted towards front right wheels 104R, and retractable member 118 may be retracted towards rear right wheels 106R. Four sensors 133 detect when retractable members 112, 114, 116, and 118, respectively, are in the retracted position and may communicate this information to controller 152. Additionally or alternatively, sensors 133 may detect when retractable members 112, 114, 116, and 118 are not in the retracted position and may communicate this information to controller 152.

Retractable members 112, 114, 116, and 118, may be pivotally attached to a support frame 120 attached to rear section 102B. Retractable members 112 and 114 may be pivoted from the retracted position in a direction towards one another to lift either a front or back tire on a left side of a vehicle, and retractable members 116 and 118 may be pivoted from the retracted position towards one another to lift either a front or back tire on a right side of a vehicle. Although Z-shuttle 100 is shown having only 4 retractable members 112, 114, 116 and 118, rear section 102B may be facilitated with another set of 4 retractable members, of which a first set of four (e.g. 112, 114, 116, and 118) may be used to lift and support the front tires of the vehicle while the second set of four retractable members may be used to lift and support the rear tires of the vehicle.

Improved z-shuttle 100 includes in rear section 102B a front retraction mechanism 122 for substantially simultaneously extending and retracting retractable members 112 and 116, and a rear retraction mechanism 124 for substantially simultaneously extending and retracting retractable members 114 and 118. Retraction mechanisms 122 and 124 may be electrically operated and may include electric motors, and each may drive a shaft 126 which retracts and extends retractable members 112, 114, 116, and 118. Alternatively, retractable members 112, 114, 116, and 118 may be extended and retracted using hydraulic means which may include the use of hydraulic pistons, and may be used in combination with retraction mechanisms 122 and 124. Alternatively, retractable members 112, 114, 116, and 118 may be extended and retracted using a combination of electrical and hydraulic means.

As shown in the Figures, each retractable member 112, 114, 116, and 118 presents a cylindrically shaped roller 128 and a sloping wing-like surface 130. These rollers 128 and wing-like surfaces 130 allow improved z-shuttle 100 to lift the vehicle tires off the ground and to firmly grip the tires to immobilize the vehicle. This firm grip advantageously allows the shuttle cars to move the vehicle at high speeds through the parking garage 100 and allows for rapid acceleration and deceleration without losing a grip on the vehicle.

Tire positioning sensors 132 in improved z-shuttle 100 detect the position and spacing of the tires of a vehicle relative to cart 102. Sensors 132 may be individually installed on cart 101 or may form part of guiding system 150. Sensors 132 may be implemented using cameras, photo detectors, laser detectors, electromechanical switches, hydraulic switches, or the like. In various embodiments, sensors 132 may be used to measure the distance between a reference point on the front tire and a reference point on the rear tire. In some embodiments, sensors 132 can also measure the location of the front tire and rear tire in relation to a fixed scale such as a ruler running the length of an entry/exit bay or a vehicle lift. As described below, the measurements taken by sensors 132 allow for improved z-shuttles 100 to space the proper distance between themselves as they transport the vehicle inside the automated parking facility.

In embodiments, improved z-shuttle 100 may contain a battery, fuel cell, fuel tank, or other source of energy. This energy source is used to power motors 108, 110L and 110R or other propelling means. Alternatively, improved z-shuttle 100 may obtain power from a remote power source such as bus bars, a contactless power source, or a power cable.

Example of Operation of Shuttle Cars in Automated Parking Facilities

In operation, a driver of a vehicle may drive his vehicle into an entry bay or a vehicle lift in an automated parking facility. In some embodiments, the vehicle lift may be integrated into the entry bay. The vehicle lift may also include a rotating platform to rotate the vehicle if necessary. Once the vehicle is driven into the entry bay or into the vehicle lift, the driver of the vehicle may exit the vehicle.

Upon driver exiting of the vehicle and also generally the entry bay, two improved z-shuttles 100 may be guided under the vehicle using their guiding system 150, a first shuttle positioned with respect to the front tires of the vehicle and the second shuttle with respect to the rear tires of the vehicle. Guiding system 150 may direct improved z-shuttles 100 under the vehicle by following a ruler marked on the floor surface of the entry bay or of the vehicle lift, and/or by detecting other markings which may serve to guide the shuttles, for example markings on walls, or even on the vehicle itself. Each improved z-shuttle 100 may travel back and forth and laterally to properly align itself with the tires of the vehicle, even if the vehicle is not properly aligned in the entry bay or in the lift. Proper alignment of improved z-shuttles 100 with the vehicle tires may be assisted by tire positioning sensors 132 on each cart 102.

Following proper positioning of improved z-shuttles 100 relative to the front and rear vehicle tires, retractable member 112, 114, 116, and 118, are extended pushing on the tires and lifting them up, and securing the vehicle in place. The vehicle may now be transported to the appropriate floor in the lift, a distance between the two improved z-shuttles during transport continuously measured using guiding system 150 with controller 152 correcting for any deviations. Movement along the automated parking facility may be directed by guiding system 150 detecting markings, rulers, and other guiding means which serve to indicate to improved z-shuttles 100 a path of travel.

While the vehicle is in transit to the appropriate floor, a floor positioning shuttle may position itself in front of the lift in preparation for retrieving the vehicle. After the vehicle reaches the appropriate floor, improved z-shuttles 100 will travel off the lift transporting the vehicle onto the floor positioning shuttle. Any misalignment between the position of the floor positioning shuttle and the lift may be corrected by linear and lateral motion in the two improved z-shuttles 100.

Once the vehicle is transported by improved z-shuttles onto the floor positioning shuttle, the floor positioning shuttle may then move along the floor until reaching a designated parking space for the vehicle. Upon reaching the space, the floor positioning shuttle may stop in front of the designated parking space and improved z-shuttles 100 transport the vehicle off the floor positioning shuttle and into the designated parking space. Any misalignment between a stopping position of the floor positioning shuttle and the parking space may be corrected by linear and lateral motion in the two improved z-shuttles 100. If vehicles obstruct the destination parking space other improved z-shuttles or other means may be used to move the obstructing vehicles. Alternately, the improved z-shuttles 100 may lower the vehicle they are transporting and position themselves under the obstructing vehicle to move the vehicle. If a direction of parking in the designated parking space is not in a same direction as the linear motion in improved z-shuttles 100, the shuttles may compensate by increasing lateral motion to allow accommodating the vehicle inside the parking space.

After improved z-shuttles 100 have positioned the vehicle in the destination parking space, the rear retractable members 112, 114, 116, and 118 are retracted towards the sides of cart 102, thus allowing the vehicle's tires to slide off of the retractable members and onto the floor of the destination parking space. The improved z-shuttles 100 may then be returned to the floor positioning shuttle and back to the entry bay to await arrival of a new vehicle. Otherwise, the improved z-shuttles 100 may be left anywhere convenient in the automated parking facility to be used for vehicle retrieval.

Example of Vehicle Retrieval in Automated Parking Facility

The process for retrieving a vehicle from a parking space is largely the reverse of that for storing a vehicle. Upon receiving a signal to retrieve the vehicle in a particular parking space, the two improved z-shuttles 100 will travel under the vehicle and position themselves accordingly as previously described when a vehicle arrives at the entry/exit bay, one aligned with the front tires and the other aligned with the rear tires. It may be noted that each improved z-shuttle 100 may be equally adapted to lift the front tires and the rear tires of the vehicle. Once properly positioned, improved z-shuttles 100 will lift the tires of vehicle off the ground and transport the vehicle back to a waiting floor positioning shuttle. Any misalignments between the floor positioning shuttle and the parking space may be compensated by linear and lateral motion in the improved z-shuttles 100. The floor positioning shuttle will then travel to the nearest available vehicle lift and the improved z-shuttles 100 will unload the vehicle from the floor positioning shuttle and transport it onto the elevator. As previously mentioned any misalignments between the floor positioning shuttle and the lift may be compensated by linear and lateral motion in the improved z-shuttles 100. The vehicle lift will then transport the improved z-shuttles 100 carrying the vehicle to the ground floor, where it can be retrieved by its owner in the entry/exit bay.

While certain features of the invention have been illustrated and described herein, many modifications, substitutions, changes, and equivalents will now occur to those of ordinary skill in the art. It is, therefore, to be understood that the appended claims are intended to cover all such modifications and changes as fall within the true spirit of the invention.

What is claimed is:

1. A vehicle shuttle car operable to travel in linear and lateral directions comprising:

a low profile cart including a steerable front section and a rear section, said front section operable to turn left and right relative to said rear section, and said rear section operable to raise and support at least one tire of a vehicle off the ground;

a plurality of sensors configured to measure distances between at least two different reference points in the vehicle and measure a location of a front and rear tires of the vehicle in relation to a ruler;

a communication unit configured to wirelessly communicate with another communication unit; and a controller configured to:

communicate wirelessly with a controller of another shuttle car, via the communication unit;

receive from the plurality of sensors of the shuttle car and the plurality of sensors of the other shuttle car distances between reference points on the rear and front tires of the vehicle and the location of the front and the rear tires of the vehicle in relation to the ruler;

guide the shuttle car to a position below the vehicle with respect to the front tires; and control the shuttle car to be aligned with the front tires and the other shuttle car to be aligned with rear tires during transportation of the vehicle, wherein controlling the alignment of the shuttle car and the other shuttle car is based on the received distances between the reference points of the rear and front tires of the vehicle and the received location of the front and the rear tires of the vehicle in relation to the ruler.

2. A vehicle shuttle car according to claim 1 further comprising a first drive mechanism for driving wheels on a left side of said front section and a second drive mechanism for driving wheels on a right side of said front section.

3. A vehicle shuttle car according to claim 2 wherein said first drive mechanism and said second drive mechanism are operable to drive said left side wheels and said right side wheels at different speeds.

4. A vehicle shuttle car according to claim 3 further comprising a third drive mechanism for driving wheels on a left side and a right side of said rear section.

5. A vehicle shuttle car according to claim 4 wherein said first, second, and third drive mechanisms include at least one of an electric motor and a hydraulic motor.

6. A vehicle shuttle according to claim 1 further comprising a guiding system to direct vehicle shuttle travel in a linear direction and a lateral direction.

7. A vehicle shuttle according to claim 6 wherein said guiding system comprises an image detector to detect images and markings in the automated parking facility.

8. A vehicle shuttle according to claim 7 wherein said image detector comprises any one of, or any combination of, a laser detector, a video camera, an infrared detector, or a photo detector.

9. A vehicle shuttle according to claim 1 further comprising a vehicle lifting system comprising at least four extendable members for pushing on the tires of a vehicle for lifting the vehicle.

10. A vehicle shuttle according to claim 9 wherein said at least four extendable members are retractable against sides of said cart.

11. A vehicle shuttle according to claim 9 wherein said vehicle lifting system comprises at least one retraction mechanism for extending and retracting said at least four extendable members.

12. A vehicle shuttle according to claim 11 wherein said at least one retraction mechanism includes an electric motor.

13. A vehicle shuttle according to claim 11 wherein said at least one retraction mechanism includes a hydraulic piston.

* * * * *